US006457449B1

(12) United States Patent
Troxler et al.

(10) Patent No.: US 6,457,449 B1
(45) Date of Patent: Oct. 1, 2002

(54) MOTORCYCLE ENGINE CAM CHEST HAVING REED VALVE ASSEMBLY

(75) Inventors: Paul J. Troxler, Brookfield, WI (US); Jesse Dees, Slinger, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 09/903,333

(22) Filed: Jul. 11, 2001

(51) Int. Cl.[7] ..... F01M 1/100
(52) U.S. Cl. ..... 123/196 R; 123/196 CP
(58) Field of Search ..... 123/196 R, 196 CP, 123/41.86, 90.36

(56) References Cited

U.S. PATENT DOCUMENTS 4,601,267 A * 7/1986 Kronich ..... 123/41.86
4,662,322 A * 5/1987 Tamba et al. ..... 123/41.86
4,688,529 A * 8/1987 Mitadera et al. ..... 123/196 R
5,709,185 A * 1/1998 Aizawa et al. ..... 123/196 R
5,975,042 A * 11/1999 Aizawa et al. ..... 123/196 R
6,039,020 A * 3/2000 Kawamoto et al. ..... 123/196 R
6,047,678 A * 4/2000 Kurihara et al. ..... 123/196 R
6,363,904 B1 * 4/2002 Kurihara et al. ..... 123/196 R

* cited by examiner

*Primary Examiner*—Noah P. Kamen
*Assistant Examiner*—Jason A Benton
(74) *Attorney, Agent, or Firm*—Michael Best & Friedrich LLP

(57) ABSTRACT

A motorcycle engine includes a crankcase, a cam chest, and a separating wall between the crankcase and cam chest. An opening is defined in the wall and communicates between the cam chest and crankcase. A valve assembly, which is preferably a reed valve assembly, covers the opening and permits one-way flow of air from the crankcase into the cam chest in response to pressure differentials caused by reciprocation of the engine's pistons. The air is then forced into the engine's rocker boxes through the engine's pushrod tubes and forces oil in the rocker boxes to return to the crankcase through narrow oil drainback passages.

13 Claims, 5 Drawing Sheets

MOTORCYCLE ENGINE CAM CHEST HAVING REED VALVE ASSEMBLY

BACKGROUND

The invention relates to a lubrication system for a motorcycle engine, and more particularly to an apparatus for controlling the pressure differential between the crankcase and rocker box to facilitate return of oil from the rocker box to the crankcase.

SUMMARY

The invention provides a motorcycle engine comprising a crankcase, a cam chest mounted to the crankcase, and a wall between the crankcase and cam chest. The wall defines an aperture communication between the cam chest and the crankcase. A valve assembly, which is preferably a reed valve assembly, is mounted over the aperture to selectively open and close the aperture in response to pressure differences between the crankcase and the cam chest. Air is therefore forced out of the crankcase and into the cam chest. The air is then forced into the engine's rocker boxes through the engine's pushrod tubes and forces oil in the rocker boxes to return to the crankcase through narrow oil drainback passages.

Other features and advantages of the invention will become apparent to those skilled in the art upon review of the following detailed description, claims, and drawings.

Figure 1:
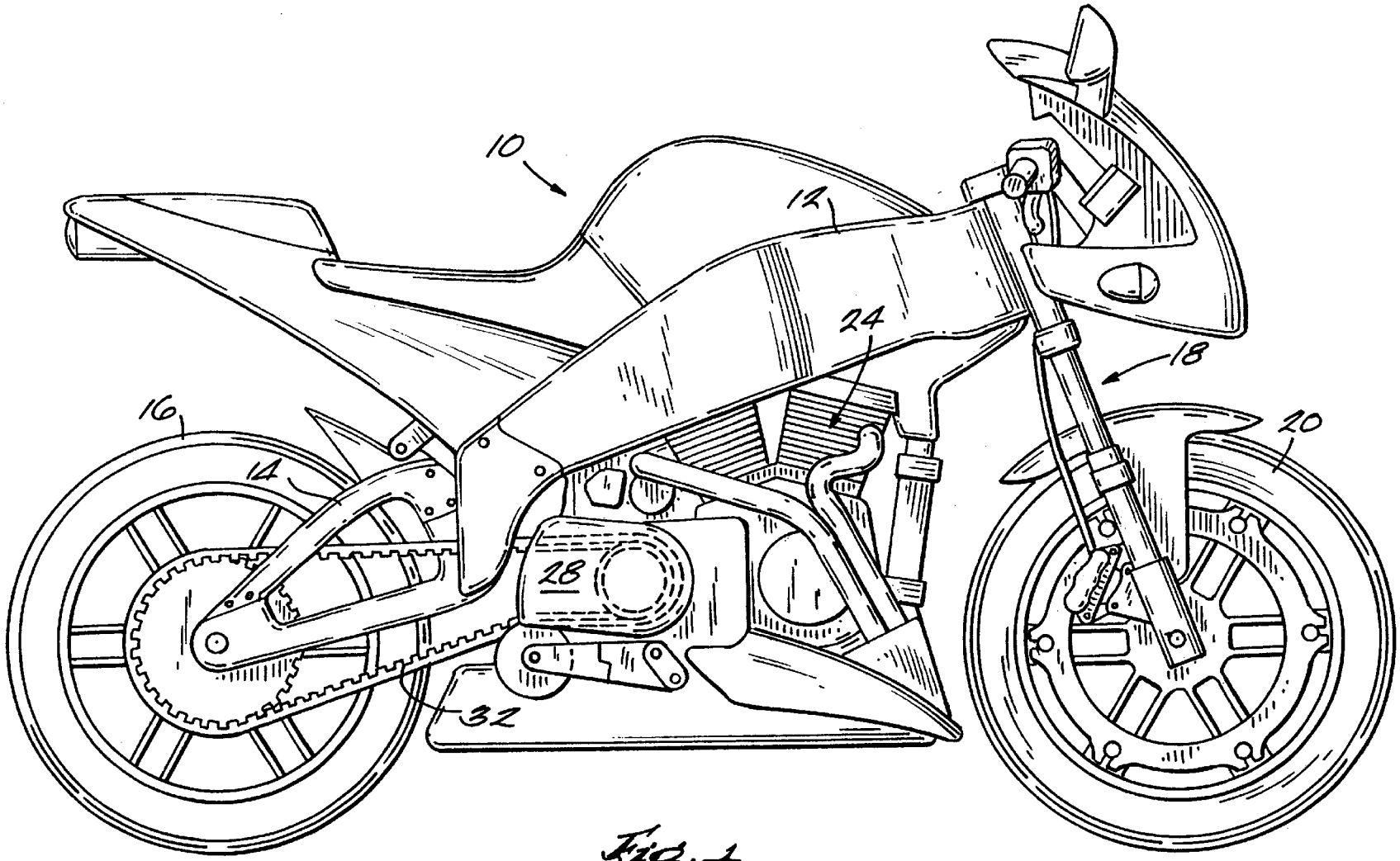
FIG. 1 is a side view of a motorcycle embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a motorcycle 10 including a frame 12, a swing arm 14 pivotably mounted to the frame 12, a rear wheel 16 rotatably mounted to the swing arm 14 to support the rear end of the motorcycle 10, a steering assembly 18, and a front wheel 20 rotatably mounted to the steering assembly 18 to support the front end of the motorcycle 10. The motorcycle 10 also includes an engine 24 and a transmission 28. The transmission 28 is coupled to the rear wheel 16 with a flexible drive member such as the illustrated belt 32 or a chain. Operation of the engine 24 causes the transmission 28 to rotate the rear wheel 16 through the drive member 32.

Figure 2:
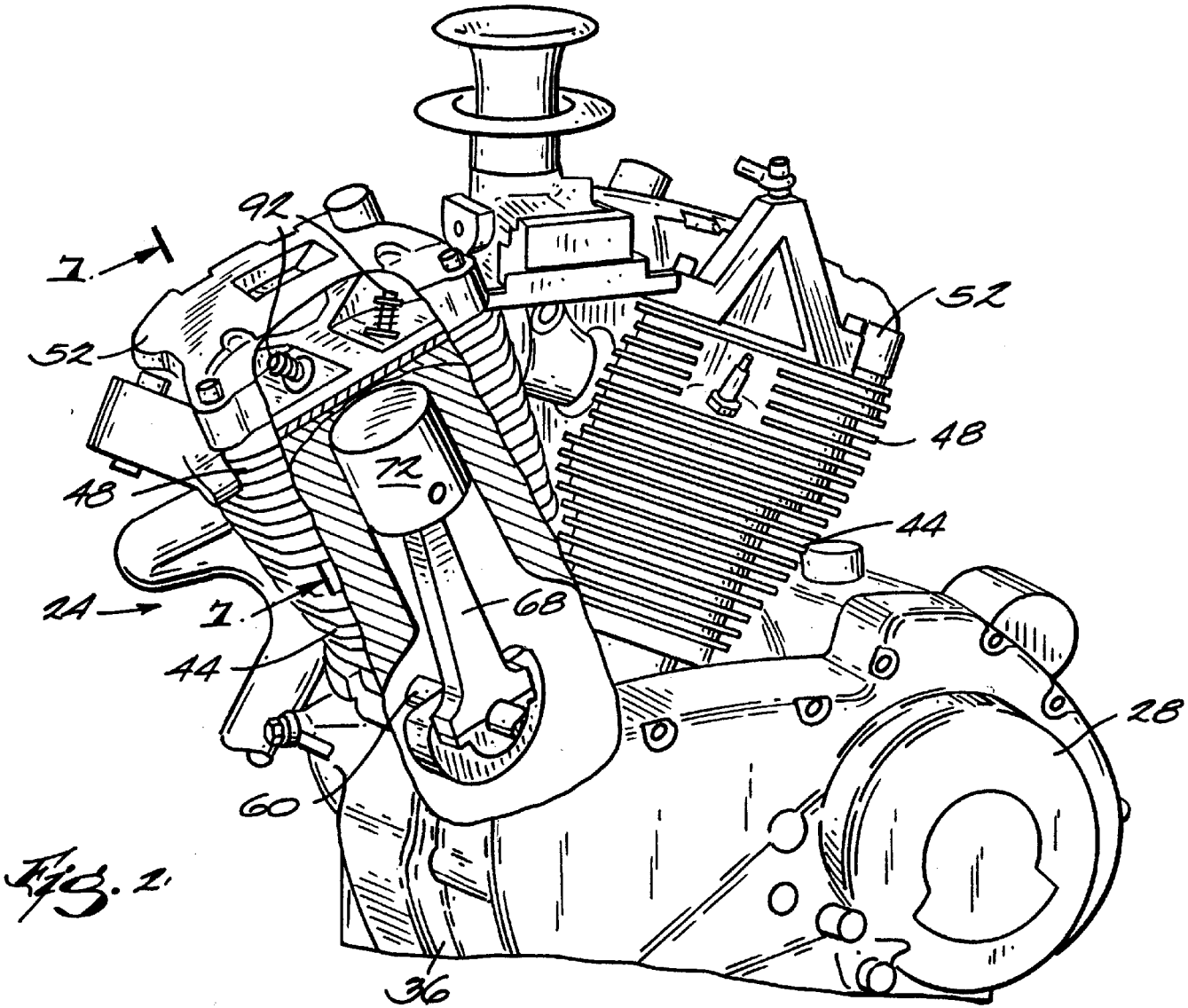
FIG. 2 is a partially cut-away view of the crankcase side of the engine of the motorcycle illustrated in FIG. 1.
Figure 3:
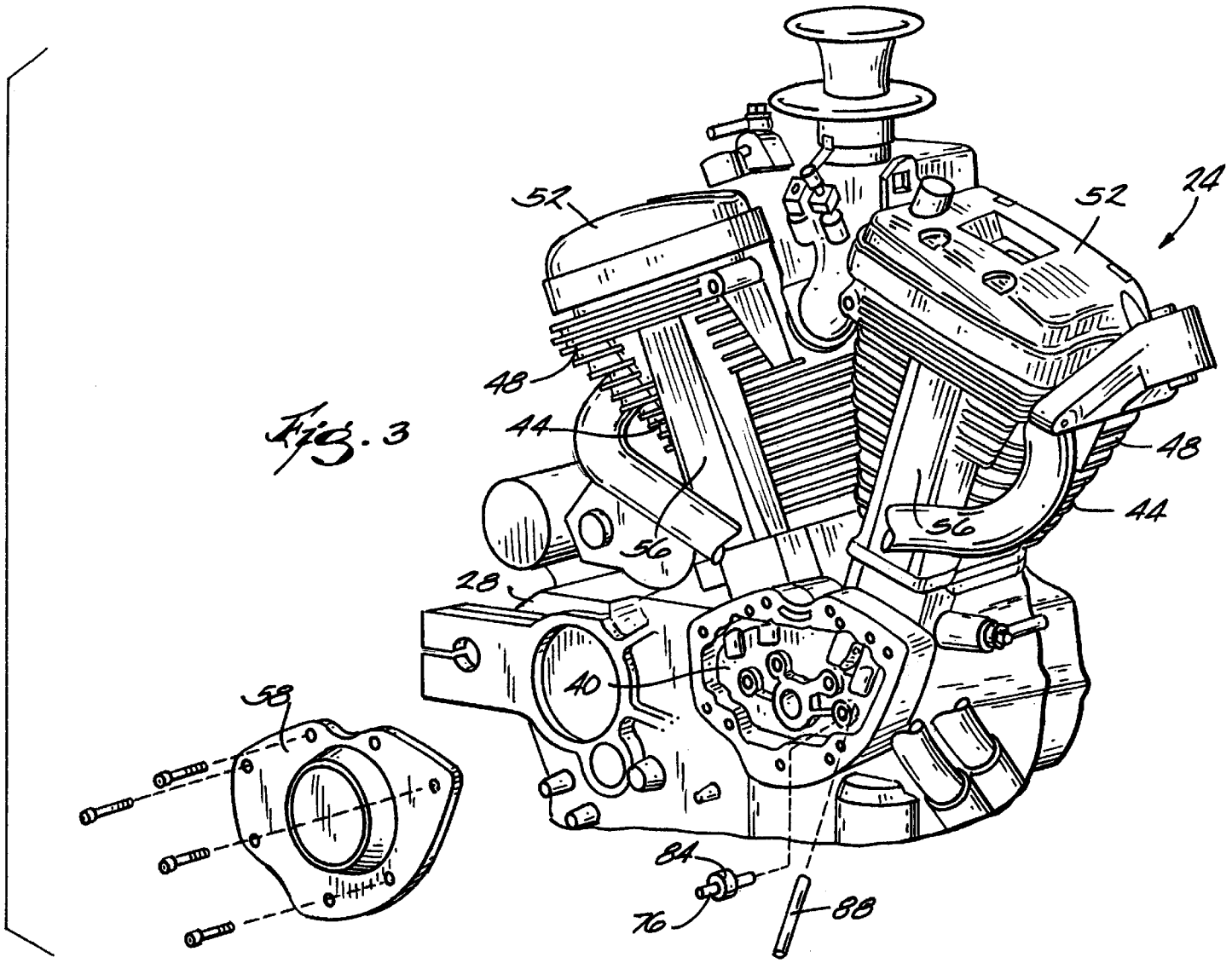
FIG. 3 is a partially exploded view of the cam chest side of the engine of the motorcycle illustrated in FIG. 1.

FIGS. 2 and 3 better illustrate the engine 24, which includes a crankcase, side illustrated in FIG. 2 and a cam chest side illustrated in FIG. 3. The engine 24 includes a crankcase 36, a cam chest 40, a pair of cylinders 44, a cylinder head 48 mounted on each cylinder 44, a rocker box 52 mounted on each cylinder head 48, and pushrod tubes 56 communicating between the cam chest 40 and the rocker boxes 52. A cam chest cover 58 encloses the cam chest 40.

Figure 6:
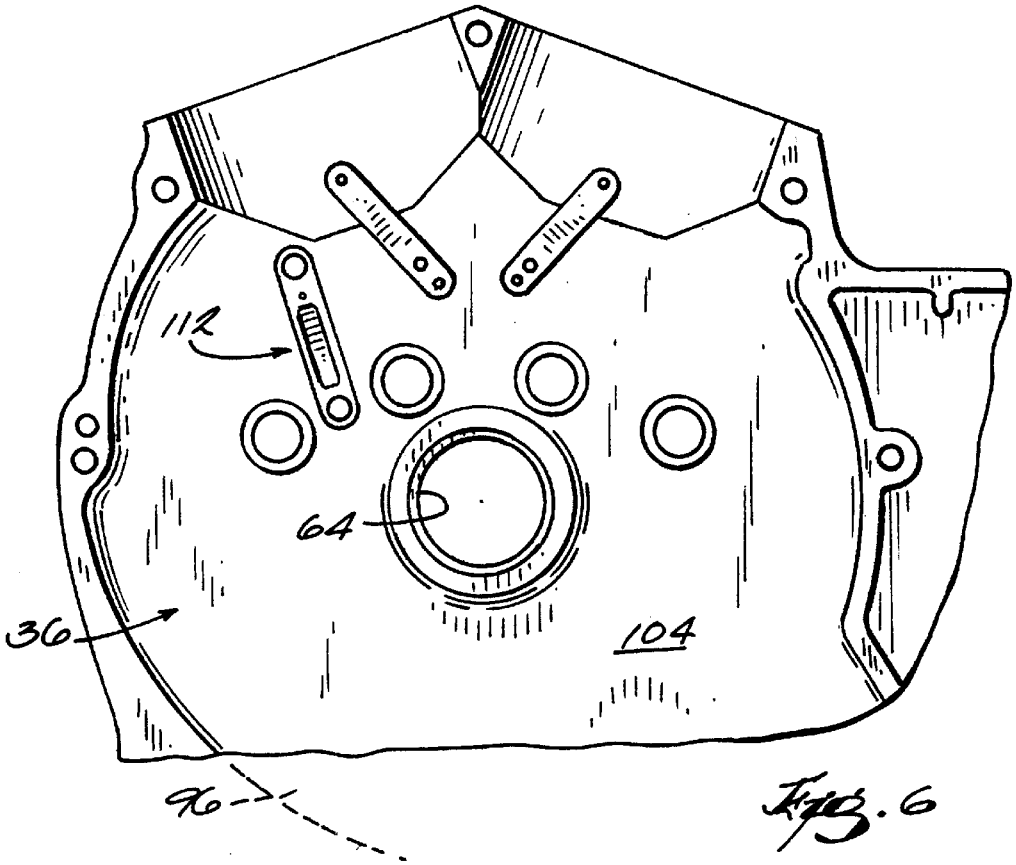
FIG. 6 is an enlarged side view of the crankcase of the engine.

As seen in FIGS. 2 and 6, a crankshaft 60 is supported by crankshaft bearings 64 for rotation within the crankcase 36. The crankshaft 60 is coupled by way of a connecting rod 68 to a piston 72 in each of the cylinders 44 such that reciprocation of the pistons 72 in the cylinders 44 causes rotation of the crankshaft 60.

Figure 4:
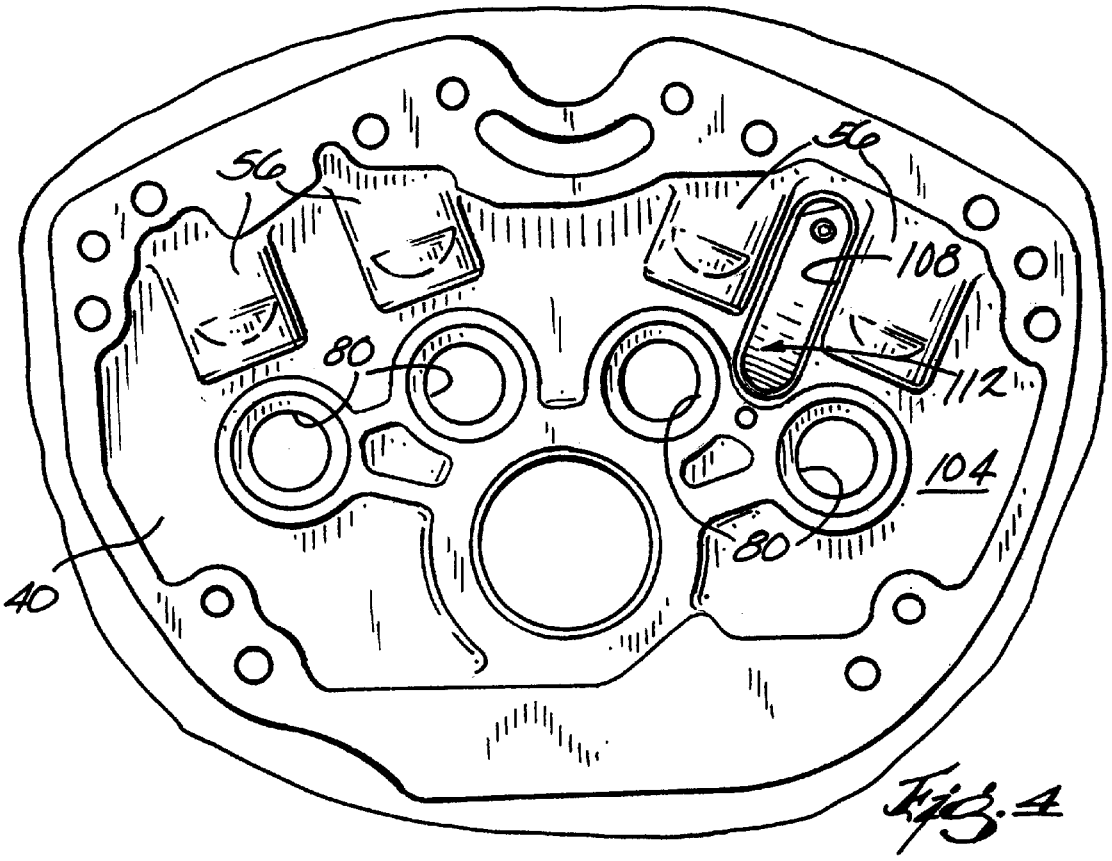
FIG. 4 is an enlarged side view of the cam chest.

With reference to FIGS. 3 and 4, four cam shafts 76 (only one of which is illustrated) are supported for rotation within the cam chest 40 in cam shaft bearings 80. The cam shafts 76 rotate in response to and in timed sequence with rotation of the crankshaft 60. The cam shafts 76 include cam lobes 84. A pushrod 88 (only one of which is illustrated) rests on a roller tappet that is supported by each cam lob 84 and extends up through one of the pushrod tubes 56 into the rocker box 52 such that rotation of the cam shaft 76 and cam lobe 84 is transformed into reciprocation of the pushrods 88 within the pushrod tubes 56.

Rocker arms (not shown) associated with each pushrod 88 are pivotably mounted in the rocker boxes 52, and are actuated in response to reciprocation of the pushrods 88. The rocker arms in turn actuate valves 92 (FIG. 2) in the cylinder heads 48 that communicate with the cylinders 44 to permit intake and exhaust from the cylinders 44 during the four-stroke cycle of the engine 24.

Figure 7:
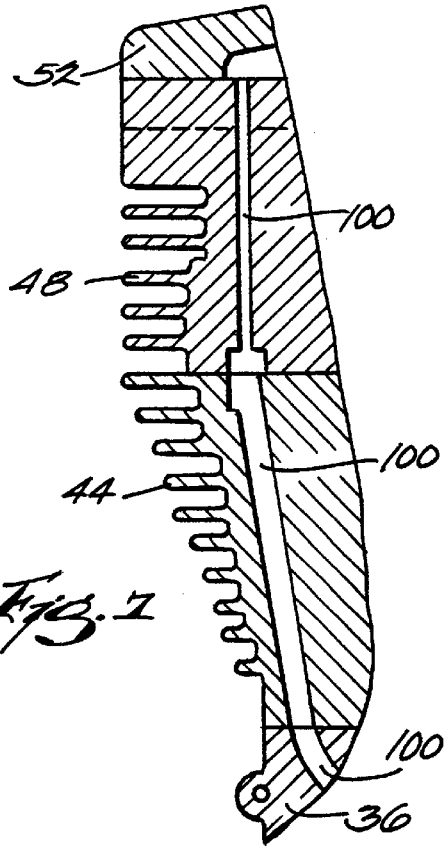
FIG. 7 is a cross-section view taken along line 7—7 in FIG. 2.

Engine lubricating oil collects in a sump portion 96 (FIG. 6) of the crankcase 36, where the oil is picked up by the scavenge portion of an oil pump. During operation of the engine 24, the lubrication portion of the oil pump provides oil to the moving parts in the engine 24, including the rocker arms and- valves 92 in the rocker boxes 52 and cylinder heads 48. A plurality of oil drainback passages 100 (FIG. 7) are defined in the cylinder heads 48, cylinders 44, and crankcase 36 and communicate between the rocker box 52 and the crankcase 36 for the return of oil to the sump 96.

As seen in FIGS. 4 and 6, a separating wall 104 separates the cam chest 40 from the crankcase 36 and includes holes for supporting the cam shaft and crankshaft bearings 80, 64. Although the separating wall 104 is preferably formed integrally with the cam chest and crankcase 40, 36, the separating wall 104 could alternatively be a separate and distinct piece from one or both of the cam chest and crankcase 40, 36. Defined within the wall 104 is an aperture 108 (FIG. 5) that permits communication between the cam chest 40 and crankcase 36.

Figure 5:
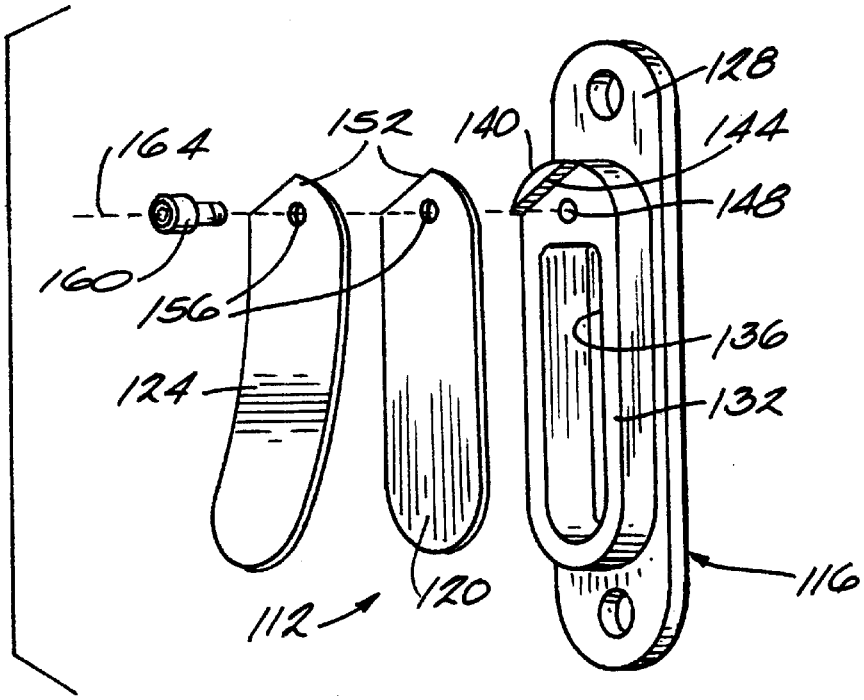
FIG. 5 is an enlarged exploded view of the reed valve assembly.

Referring to FIGS. 4 and 5, a valve assembly 112 is mounted to the separating wall 104 on the crankcase 36 side adjacent the aperture 108. The illustrated valve assembly 112 is a reed valve assembly, but other one-way valve assemblies could be substituted for the illustrated reed valve assembly. The reed valve assembly 112 includes a reed block 116, a flexible reed petal 120, and a reed stop 124. The reed block 116 is a rigid part having a substantially flat base 128 that is mounted to the wall 104 with suitable fasteners, and a collar 132 extending away from the base 128 and through the aperture 108. A bore 136 is defined through the collar 132 and base 116 and registers with the aperture 108 in the separating wall 104. Extending away from the distal end of the collar 132 is an anti-rotational protrusion 140 having a flat surface 144. There is also a threaded hole 148 in the collar 132 proximate the anti-rotational protrusion 140.

The reed petal 120 and reed stop 124 include flats 152 and holes 156, and are mounted to the reed block 116 by way of a fastener 160 extending through the holes 156 and threaded into the threaded hole 148 in the collar 132. The flats 152 of the reed petal 120 and reed stop 124 abut the flat surface 144 of the protrusion 140 such that the reed petal and reed stop 120, 124 are substantially prevented from pivoting about the longitudinal axis 164 of the threaded fastener 160. The reed stop 124 is arcuately bent away from the reed block 116, leaving a space between the reed stop 124 and the reed block 116. The reed petal 120 bends about the end anchored by the threaded fastener 160 and moves within a range of motion limited by the reed block 116 at one extreme and the reed stop 124 at the other extreme.

As the pistons 72 move upwardly within the cylinders 44, a vacuum is created within the crankcase 36, which causes the reed petal 120 to be pulled tightly against the collar portion 132 of the reed block 116 and consequently close the bore and aperture 136, 108. When the pistons 72 move back down in the cylinders 44, pressure within the crankcase 36 is increased, which drives the reed petal 120 against the reed stop 124 and opens the aperture 108. When pressure is increased in the crankcase 36, air is forced through the aperture 108 and into the cam chest 40, which in turn forces air out of the cam chest 40 and up through the pushrod tubes 56 into the rocker boxes 52. This in turn forces air and oil through the oil drainback passages 100 and into the crankcase 36.

The reed valve assembly 112 in conjunction with the reciprocating pistons 72 therefore causes a pumping action within the engine 24 that forces pressurized air through the aperture 108 and cam chest 40, and into the rocker box 52. The pistons 72 and reed valve assembly 112 also further facilitate oil drainback by creating a vacuum within the crankcase 36 as the pistons 72 travel upwardly in the cylinders 44. The reed valve assembly 112 therefore permits a higher pressure differential between the rocker box 52 and the crankcase 36 than would be present in the absence of the reed valve assembly 112. The oil drainback passages 100 have high length-to-diameter ratios and operate better in the presence of this high pressure differential, especially when a fluid of relatively high viscosity such as oil is flowing through the passages 100.

What is claimed is:

1. A motorcycle engine comprising:

a crankcase;

a cam chest mounted to said crankcase;

a wall between said crankcase and cam chest, said wall defining an aperture communicating between said cam chest and said crankcase; and a valve assembly mounted over said aperture to selectively open and close said aperture in response to pressure differences between said crankcase and said cam chest.

2. The engine of claim 1, wherein said crankcase, cam chest, and wall are integrally formed with each other.

3. The engine of claim 1, wherein said valve assembly closes said aperture in response to the pressure in said crankcase being lower than the pressure in said cam chest.

4. The engine of claim 1, wherein said valve assembly includes a flexible reed petal movable toward and away from said aperture in response to pressure differentials between said crankcase and cam chest.

5. The engine of claim 4, wherein said valve assembly further includes a substantially rigid reed stop limiting the range of motion of said flexible reed petal away from said aperture.

6. The engine of claim 4, wherein said flexible reed petal moves to open said aperture in response to higher pressure in said crankcase than in said cam chest and moves to close said aperture in response to lower pressure in said crankcase than in said cam chest.

7. The engine of claim 1, further comprising a rocker box communicating with said cam chest through at least one pushrod tube, said rocker box and said crankcase communicating through at least one oil drainback passage, wherein pressure pulses from said crankcase force air into said cam chest through said valve assembly and then into said rocker box through said pushrod tubes to force the oil out of the rocker box through said drainback passage and into said crankcase.

8. A motorcycle engine comprising:

a crankcase;

a crankshaft supported for rotation within said crankcase;

at least one cylinder mounted to said crankcase;

a piston disposed within said cylinder for reciprocal movement therein;

a connecting rod interconnecting said piston and said crankshaft such that reciprocation of said piston causes rotation of said crankshaft, said reciprocation also causing pressure fluctuations within said crankcase;

a cam chest mounted to said crankcase;

a wall separating said crankcase from said cam chest, said wall defining an aperture therethrough communicating between said crankcase and said cam chest;

a valve assembly positioned over said aperture, said valve assembly opening said aperture in response to higher pressure in said crankcase than in said cam chest and closing said aperture in response to lower pressure in said crankcase than in said cam chest;

a rocker box mounted to said cylinder;

a pushrod tube communicating between said cam chest and said rocker box; and at least one oil drainback passage communicating between said rocker box and said crankcase;

wherein said valve assembly permits air to be forced from said crankcase into said cam chest in response to increased pressure in said crankcase, which air is forced into said rocker box through said pushrod tubes causing increased pressure within said rocker box and forcing oil through said drainback passages and into said crankcase.

9. The engine of claim 8, wherein said valve assembly includes a flexible reed petal movable toward and away from said aperture to close and open, respectively, the aperture in response to pressure differentials between said crankcase and cam chest.

10. The engine of claim 9, wherein said valve assembly further includes a substantially rigid reed stop limiting the range of motion of said flexible reed petal away from said aperture.

11. A method for lubricating an engine having a crankcase, a cam chest mounted to the crankcase, a wall separating the crankcase from the cam chest, at least one cylinder mounted to the crankcase, a rocker box mounted to the cylinder, pushrod tubes communicating between the cam chest and rocker box, and at least one drainback passage communicating between the rocker box and crankcase, the method comprising:

providing an aperture in the wall between the crankcase and cam chest to cause communication therebetween;

covering the aperture with a valve assembly;

providing an oil sump in the crankcase, the oil sump containing oil;

scavenging oil from the sump to lubricate moving parts in the rocker box;

opening the valve assembly in response to pressure in the crankcase exceeding pressure in the cam chest;

moving pressurized air from the crankcase into the cam chest under the influence of the pressure differential while the valve assembly is open;

closing the valve assembly in response to pressure in the crankcase falling below pressure in the cam chest;

moving the pressurized air from the cam chest into the rocker box through the pushrod tubes; and forcing the oil through the oil drainback passage in response to the pressure in the rocker box exceeding the pressure in the crankcase.

12. The method of claim 11, wherein the valve assembly includes a reed valve, the method further comprising positioning a reed valve stop proximate the reed valve and limiting the range of motion of the reed valve with the reed valve stop.

13. The method of claim 12, wherein the act of opening includes deflecting the reed valve against the valve stop, and wherein the act of closing includes covering the aperture with the reed valve.

* * * * *